US012674472B1

(12) United States Patent
Remy et al.

(10) Patent No.: US 12,674,472 B1
(45) Date of Patent: Jul. 7, 2026

(54) IMPELLER BACK-FACE COOLING APERTURE

(71) Applicant: Pratt & Whitney Canada Corp., Longueuil (CA)

(72) Inventors: Patrice Remy, St-Hubert (CA); Ian Macfarlane, St-Bruno (CA)

(73) Assignee: PRATT & WHITNEY CANADA CORP., Longueuil (CA)

( * ) Notice: Subject to any disclaimer, the term of this patent is extended or adjusted under 35 U.S.C. 154(b) by 0 days.

(21) Appl. No.: 19/247,519

(22) Filed: Jun. 24, 2025

(51) Int. Cl.
*F04D 29/58* (2006.01)
*F04D 29/54* (2006.01)

(52) U.S. Cl.
CPC ..... *F04D 29/5846* (2013.01); *F04D 29/541* (2013.01); *F04D 29/5826* (2013.01)

(58) Field of Classification Search
CPC . F01D 5/046; F01D 9/04; F01D 9/065; F01D 11/08; F01D 11/14; F01D 11/24; F01D 25/14; F04D 29/4206; F04D 29/441; F04D 29/582; F04D 29/5846
See application file for complete search history.

(56) References Cited

U.S. PATENT DOCUMENTS 4,923,370 A 5/1990 Larson et al.
6,190,123 B1 2/2001 Wunderwald et al.
6,238,179 B1 * 5/2001 Wunderwald ..... F04D 29/5846 415/110
6,257,834 B1 7/2001 Bremer et al.
6,276,896 B1 8/2001 Burge et al.
7,252,474 B2 * 8/2007 Belokon ..... F04D 29/124 415/173.5
7,682,131 B2 3/2010 Legare et al.
7,775,758 B2 * 8/2010 Legare ..... F01D 3/04 415/105
7,841,187 B2 11/2010 Behaghel et al.
8,137,075 B2 3/2012 Howe et al.
9,829,008 B2 11/2017 Bigi et al.
10,876,535 B2 12/2020 Nagao
11,199,201 B2 12/2021 Makino et al.

FOREIGN PATENT DOCUMENTS

CN 115573776 A 1/2023
JP 2934530 B2 8/1999

* cited by examiner

*Primary Examiner* — Christopher R Legendre
(74) *Attorney, Agent, or Firm* — CANTOR COLBURN LLP

(57) ABSTRACT

A nozzle of a diffuser baffle of a compressor section of a gas turbine engine of an aircraft includes a body having circumferentially arced inboard and outboard surfaces, radially oriented side surfaces and forward and aft facing major surfaces. The body includes a baffle attached to the aft facing major surface. The baffle has a baffle surface angled relative to the aft facing major surface. The body defines an aperture, which extends through and which is angled relative to the forward and aft facing major surfaces, to define an angled flow path upstream from the baffle whereby fluid flowing through the angled flow path is directed tangentially toward and then deflected by the baffle surface.

20 Claims, 4 Drawing Sheets

IMPELLER BACK-FACE COOLING APERTURE

BACKGROUND

The present disclosure relates to gas turbine engines and, in particular, to an impeller back-face cooling aperture of a gas turbine engine, such as a gas turbine engine of an aircraft.

In a gas turbine engine, fuel and compressed air are combusted in a combustor to produce a high-temperature and high-pressure fluid. This fluid enters a turbine and interacts with rows or stages of turbine blades and vanes. The interaction between the high-temperature and high-pressure fluid with the turbine blades and vanes causes the stages of turbine blades to rotate a shaft. The shaft rotation drives a compressor to compress the air for the combustor and, as noted above, can be used to drive operations of a generator to produce electricity and/or for propulsion.

SUMMARY

According to an aspect of the disclosure, a nozzle of a diffuser baffle of a compressor section of a gas turbine engine of an aircraft is provided. The nozzle includes a body having circumferentially arced inboard and outboard surfaces, radially oriented side surfaces and forward and aft facing major surfaces. The body includes a baffle attached to the aft facing major surface. The baffle has a baffle surface angled relative to the aft facing major surface. The body defines an aperture, which extends through and which is angled relative to the forward and aft facing major surfaces, to define an angled flow path upstream from the baffle whereby fluid flowing through the angled flow path is directed tangentially toward and then deflected by the baffle surface.

In accordance with at least one or more additional and/or alternative embodiments, the circumferentially arced outboard surface is longer than the circumferentially arc inboard surface, the radially oriented side surfaces extend between corresponding edges of the circumferentially arced inboard and outboard surfaces and the circumferentially arced inboard and outboard surfaces and the radially oriented side surfaces delimit the forward and aft facing major surfaces.

In accordance with at least one or more additional and/or alternative embodiments, the forward and aft facing major surfaces are planar surfaces and define respective planes thereof and the baffle surface and the aperture are each angled relative to at least the plane of the aft facing major surface and the baffle surface forms an acute angle relative to at least the plane of the aft facing major surface and the aperture forms an acute angle relative to at least the plane of the aft facing major surface.

In accordance with at least one or more additional and/or alternative embodiments, the baffle surface includes a bifurcating baffle to radially bifurcate a flow of the fluid into first and second flows.

According to an aspect of the disclosure, a compressor section of a gas turbine engine of an aircraft is provided. The compressor section includes an impeller, a diffuser baffle proximate to the impeller, whereby the impeller and the diffuser baffle define an intervening cavity therebetween, a nozzle installed in the diffuser baffle and configured to direct a flow of coolant into the intervening cavity in a direction comprising circumferential and axial directional components and piping extending through the diffuser baffle and terminating in the nozzle to deliver the flow of the coolant to the nozzle.

In accordance with at least one or more additional and/or alternative embodiments, the compressor section further includes a compressor and a heat exchanger, wherein the coolant includes compressed air which is bled from the compressor and passed through the heat exchanger.

In accordance with at least one or more additional and/or alternative embodiments, the compressed air is compressed to a highest degree by the compressor.

In accordance with at least one or more additional and/or alternative embodiments, the piping extends from the heat exchanger and to and through the diffuser baffle.

In accordance with at least one or more additional and/or alternative embodiments, the nozzle includes a body having circumferentially arced inboard and outboard surfaces, radially oriented side surfaces and forward and aft facing major surfaces, the body includes a baffle attached to the aft facing major surface, the baffle having a baffle surface angled relative to the aft facing major surface and the body defines an aperture, which extends through and which is angled relative to the forward and aft face major surfaces, to define an angled flow path upstream from the baffle whereby the coolant flows through the angled flow path and is directed circumferentially and tangentially toward the baffle surface and then is deflected axially by the baffle surface.

In accordance with at least one or more additional and/or alternative embodiments, the circumferentially arced outboard surface is longer than the circumferentially arc inboard surface, the radially oriented side surfaces extend between corresponding edges of the circumferentially arced inboard and outboard surfaces and the circumferentially arced inboard and outboard surfaces and the radially oriented side surfaces delimit the forward and aft facing major surfaces.

In accordance with at least one or more additional and/or alternative embodiments, the forward and aft facing major surfaces are planar surfaces and define respective planes thereof and the baffle surface and the aperture are each angled relative to at least the plane of the aft facing major surface and the baffle surface forms an acute angle relative to at least the plane of the aft facing major surface and the aperture forms an acute angle relative to at least the plane of the aft facing major surface.

In accordance with at least one or more additional and/or alternative embodiments, the baffle surface includes a bifurcating baffle to radially bifurcate a flow of the fluid into first and second flows.

According to aspect of the disclosure, a compressor section of a gas turbine engine of an aircraft is provided. The compressor section includes an impeller including an impeller front-face along which high-temperature air flows and an impeller back-face opposite the impeller front-face, a diffuser baffle proximate to the impeller, whereby the impeller back-face and the diffuser baffle define an intervening cavity therebetween, a nozzle installed in the diffuser baffle and configured to direct a flow of coolant into the intervening cavity and tangentially toward the impeller back-face in a direction comprising circumferential and axial directional components and piping extending through the diffuser baffle and terminating in the nozzle to deliver the flow of the coolant to the nozzle.

In accordance with at least one or more additional and/or alternative embodiments, the compressor section further includes a compressor and a heat exchanger, wherein the coolant includes compressed air which is bled from the compressor and passed through the heat exchanger.

In accordance with at least one or more additional and/or alternative embodiments, the compressed air is compressed to a highest degree by the compressor.

In accordance with at least one or more additional and/or alternative embodiments, the piping includes first piping extending from a highest stage of the compressor to the heat exchanger and second piping extending from the heat exchanger to and through the diffuser baffle.

In accordance with at least one or more additional and/or alternative embodiments, the nozzle includes a body having circumferentially arced inboard and outboard surfaces, radially oriented side surfaces and forward and aft facing major surfaces, the body includes a baffle attached to the aft facing major surface, the baffle having a baffle surface angled relative to the aft facing major surface, and the body defines an aperture, which extends through and which is angled relative to the forward and aft face major surfaces, to define an angled flow path upstream from the baffle whereby the coolant flows through the angled flow path and is directed circumferentially and tangentially toward the baffle surface and then is deflected axially by the baffle surface.

In accordance with at least one or more additional and/or alternative embodiments, the circumferentially arced outboard surface is longer than the circumferentially arc inboard surface, the radially oriented side surfaces extend between corresponding edges of the circumferentially arced inboard and outboard surfaces and the circumferentially arced inboard and outboard surfaces and the radially oriented side surfaces delimit the forward and aft facing major surfaces.

In accordance with at least one or more additional and/or alternative embodiments, the forward and aft facing major surfaces are planar surfaces and define respective planes thereof and the baffle surface and the aperture are each angled relative to at least the plane of the aft facing major surface and the baffle surface forms an acute angle relative to at least the plane of the aft facing major surface and the aperture forms an acute angle relative to at least the plane of the aft facing major surface.

In accordance with at least one or more additional and/or alternative embodiments, the baffle surface includes a bifurcating baffle to radially bifurcate a flow of the fluid into first and second flows.

Additional features and advantages are realized through the techniques of the present disclosure. Other embodiments and aspects of the disclosure are described in detail herein and are considered a part of the claimed technical concept. For a better understanding of the disclosure with the advantages and the features, refer to the description and to the drawings.

BRIEF DESCRIPTION OF THE DRAWINGS

For a more complete understanding of this disclosure, reference is now made to the following brief description, taken in connection with the accompanying drawings and detailed description, wherein like reference numerals represent like parts.

DETAILED DESCRIPTION

The following disclosure is applicable to any type of gas turbine engine, including, but not limited to, turbofans, turboshafts, turboprops, turbojets, electrical drives, hybrid drives, etc. The gas turbine engine described below is provided by way of example, and should not be interpreted as limiting the scope of the application or the claims in any way.

Figure 1:
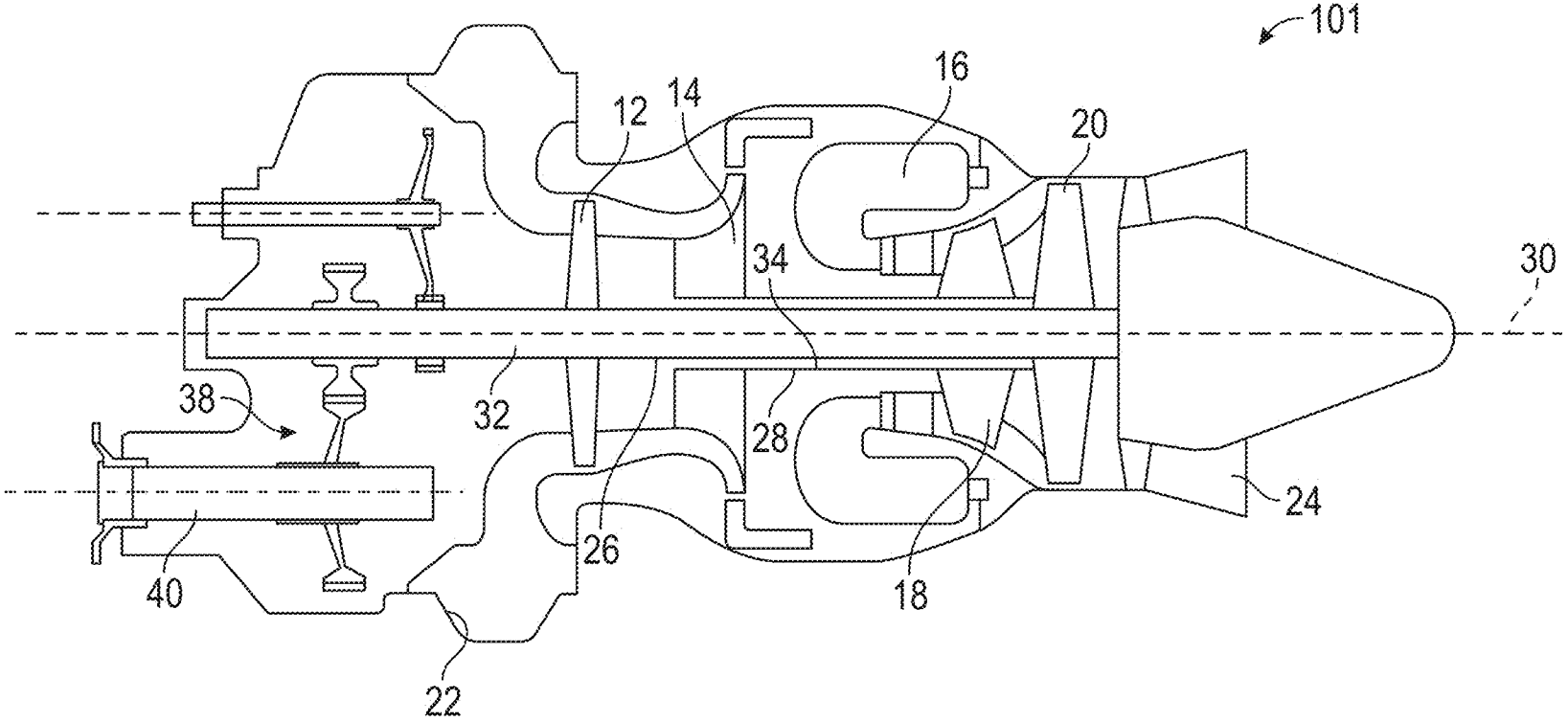
FIG. 1 (PRIOR ART)
FIG. 1 is a cross-sectional view of a prior art turboshaft engine.

With reference to FIG. 1, a turboshaft engine 101 is provided and configured as a gas turbine engine. In particular, the turboshaft engine 101 is a generally conventional turboshaft engine generally including, in serial flow communication, a low pressure (LP) compressor section 12 and a high pressure (HP) compressor section 14 for pressurizing air, a combustor 16 in which the compressed air is mixed with fuel and ignited for generating an annular stream of hot combustion gases, a high pressure turbine section 18 for extracting energy from the combustion gases and driving the high pressure compressor section 14 and a lower pressure turbine section 20 for further extracting energy from the combustion gases and driving at least the low pressure compressor section 12.

The low pressure compressor section 12 may independently rotate from the high pressure compressor section 14. The low pressure compressor section 12 may include one or more compression stages and the high pressure compressor section 14 may include one or more compression stages. A compressor stage may include a compressor rotor, or a combination of the compressor rotor and a compressor stator assembly. In a multistage compressor configuration, the compressor stator assemblies may direct the air from one compressor rotor to the next.

The turboshaft engine 101 has multiple, i.e. two or more, spools which may perform the compression to pressurize the air received through an air inlet 22, and which extract energy from the combustion gases before they exit via an exhaust outlet 24. For example, the turboshaft engine 101 can include a low pressure spool 26 and a high pressure spool 28 mounted for rotation about an engine axis 30. The low pressure and high pressure spools 26, 28 are independently rotatable relative to each other about the axis 30. The term "spool" is herein intended to broadly refer to drivingly connected turbine and compressor rotors.

The low pressure spool 26 includes a low pressure shaft 32 interconnecting the low pressure turbine section 20 with the low pressure compressor section 12 to drive rotors of the low pressure compressor section 12. In other words, the low pressure compressor section 12 may include at least one low pressure compressor rotor directly drivingly engaged to the low pressure shaft 32 and the low pressure turbine section 20 may include at least one low pressure turbine rotor directly drivingly engaged to the low pressure shaft 32 so as to rotate the low pressure compressor section 12 at a same speed as the low pressure turbine section 20. The high pressure spool 28 includes a high pressure shaft 34 interconnecting the high pressure turbine section 18 with the high pressure compressor section 14 to drive rotors of the high pressure compressor section 14. In other words, the high pressure compressor section 14 may include at least one high pressure compressor rotor directly drivingly engaged to the high pressure shaft 34 and the high pressure turbine section 18 may include at least one high pressure turbine rotor directly drivingly engaged to the high pressure shaft 34 so as to rotate the high pressure compressor section 14 at a same speed as the high pressure turbine section 18. In some embodiments, the high pressure shaft 34 may be hollow and the low pressure shaft 32 extends therethrough. The two shafts 32, 34 are free to rotate independently from one another.

The turboshaft engine 101 may further include a transmission 38 driven by the low pressure shaft 32 and driving a rotatable output shaft 40. The transmission 38 may vary a ratio between rotational speeds of the low pressure shaft 32 and the output shaft 40.

Within the high-pressure compressor section 14, high-temperature and high-pressure air flows along a gap formed between an impeller and an impeller shroud and between the impeller and a back-face baffle (can be called either a back-face baffle or a diffuser baffle, since it is normally attached to the diffuser, but functionally it is an impeller back-face baffle) and is used to provide pressurized air to an engine secondary air system (SAS). This high-temperature and high-pressure air tends to heat the impeller as if flows past the impeller back-face, which can reduce material capabilities, thus necessitating an introduction of cooling air flow to help reduce impeller metal temperatures.

While various schemes have been proposed to provide for and increase impeller cooling, these schemes tend to be ineffective or tend to create additional problems. For example, injecting cooling flows perpendicularly toward the impeller can increase friction or swirl that reduces the cooling effect. As another example, reducing the gap between the impeller and the baffle can increase friction and lead to increased temperatures A need therefore exists for a gas turbine engine, such as a gas turbine engine of an aircraft, in which cooling air flows are directed tangentially toward the back-face of the impeller within the high-pressure compressor section 14.

Thus, as will be described below, a system is provided to cool the back-face of the impeller using cooled bleed air that is tapped from a high-pressure location, such as compressed air that is bled from the highest stage of a compressor section (i.e., P3 air) and subsequently passed through a heat exchanger and re-injected tangentially toward the back-face of the impeller.

Figure 2B:
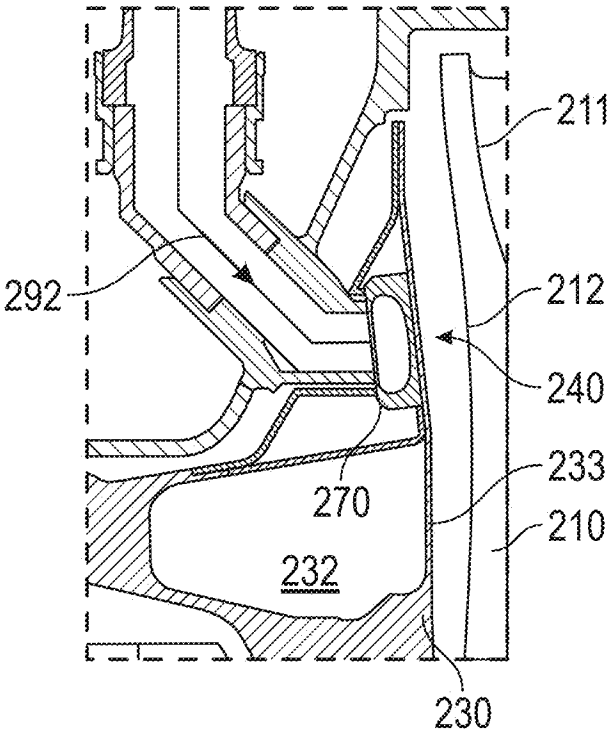
FIG. 2B is an enlarged side view of the portion of the compressor section enclosed by line 2B of FIG. 2A in accordance with embodiments.
Figure 2A:
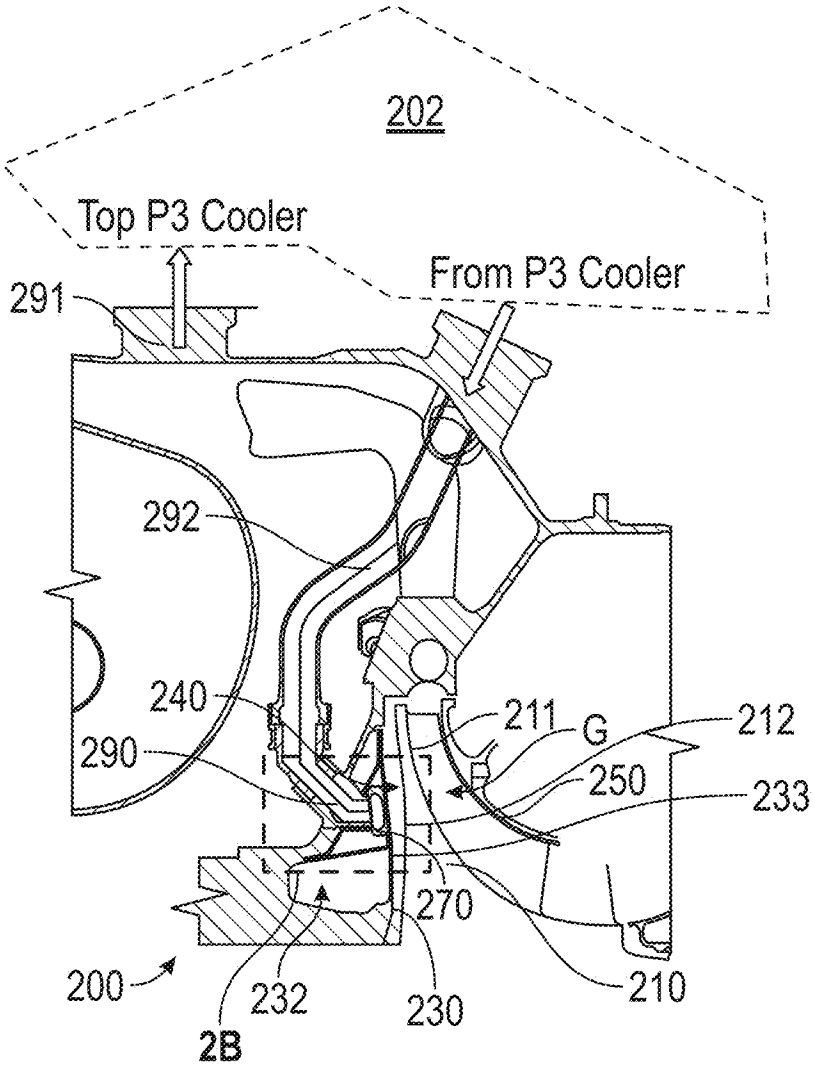
FIG. 2A is a side view of a compressor section of a gas turbine engine of an aircraft with a nozzle and piping to generate a flow of coolant in accordance with embodiments.

With reference to FIGS. 2A and 2B, a compressor section 200 of a gas turbine engine of an aircraft, such as the high-pressure compressor section 14 of FIG. 1, is provided. The compressor section 200 includes an impeller 210, a diffuser baffle 230, an impeller shroud 250, a nozzle 270 and piping 290. The impeller 210 includes an impeller front-face 211 and an impeller back-face 212. The impeller shroud 250 faces the impeller front-face 211 at a distance to define a gap G. High-temperature air flows can be directed to flow through the gap G and along the impeller front-face 211. The impeller back-face 212 is disposed opposite the impeller front-face 211. The diffuser baffle 230 is proximate to the impeller back-face 212, whereby the impeller back-face 212 and the diffuser baffle 230 define an intervening cavity 240 therebetween. The diffuser baffle 230 can be formed to define an internal cavity 232 and can include a second front-face 233. The second front-face 233 faces the impeller back-face 212 across the intervening cavity 240. The nozzle 270 can be installed in or at the second front-face 233 of the diffuser baffle 230 and is configured to direct a flow of coolant into the intervening cavity 240 and tangentially toward the impeller back-face 212 in a direction that includes a circumferential directional component CDC (see FIG. 3 and FIG. 4B) and an axial directional component ADC (see FIG. 4B). The piping 290 extends through the diffuser baffle 230 and terminates in or at the nozzle 270 to deliver the flow of the coolant to the nozzle 270.

The compressor section 200 can further include a compressor as shown in FIG. 1 and a heat exchanger 202 and the coolant can include or be provided as compressed air that is bled from the compressor and passed through the heat exchanger 202. In accordance with embodiments, the compressed air can be air that is compressed to a highest degree by the compressor (i.e., P3 air). This highly compressed air can be bled from the compressor and passed through the heat exchanger 202 and still have sufficient pressure to serve as coolant for the impeller 210. Where the compressor section 200 includes the compressor and the heat exchanger 202, the piping 290 can include first piping 291 and second piping 292. The first piping 291 extends from a cavity fluidly communicative with a highest stage of the compressor, through a gas turbine engine casing and to the heat exchanger 202. The second piping 292 extends from the heat exchanger 202 into and through the gas turbine engine casing and to and through the diffuser baffle 230 to the nozzle 270.

It is to be understood that the compressor section 200 can include multiple sets of the nozzle 270 and the piping 290. These multiple sets of the nozzle 270 and the piping 290 can be distributed evenly or unevenly about a centerline of the diffuser baffle 230 (see FIG. 3).

Figure 4A:
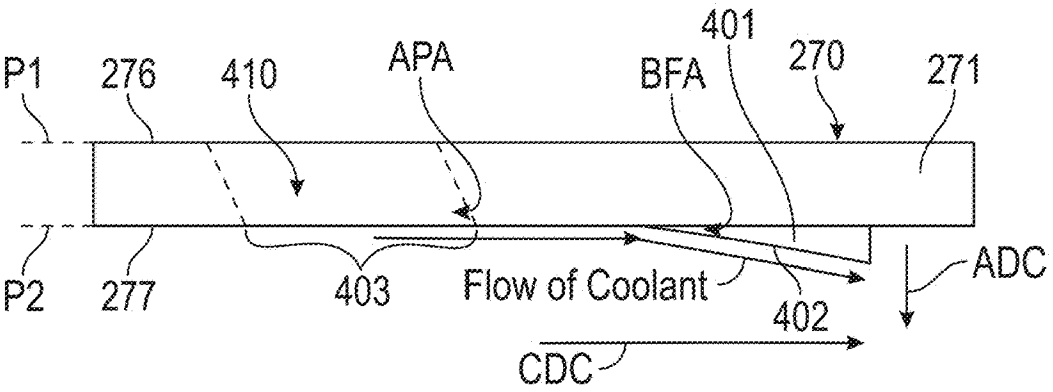
FIG. 4A is a perspective view of a nozzle with an aperture and a baffle in accordance with embodiments.
Figure 4B:
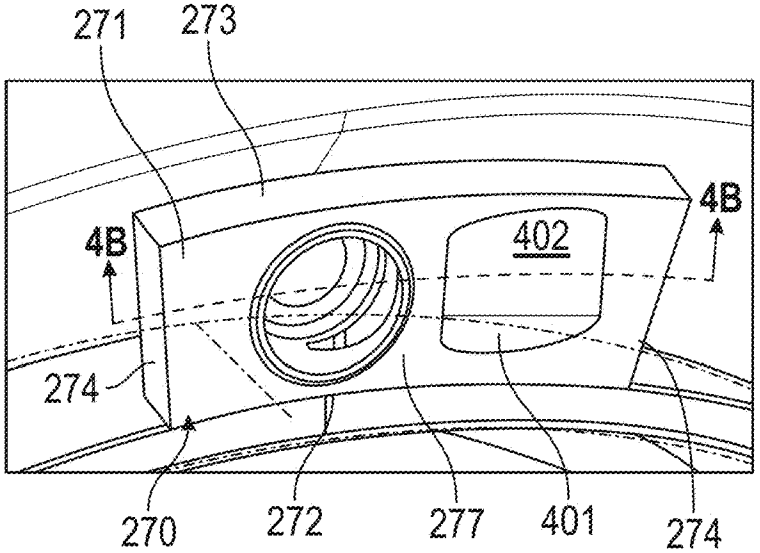
FIG. 4B is a cross-sectional view of the nozzle of FIG. 4A taken along line 4B-4B in accordance with embodiments.
Figure 3:
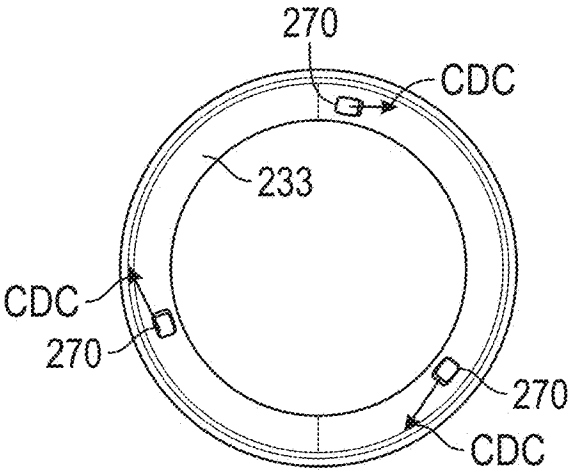
FIG. 3 is an axial view of a diffuser baffle with nozzles distributed about a centerline in accordance with embodiments.

With continued reference to FIGS. 2A and 2B and with additional reference to FIG. 3 and FIGS. 4A and 4B, the nozzle 270 includes a body 271 that has circumferentially arced inboard and outboard surfaces 272, 273, radially oriented side surfaces 274, 275 and forward and aft facing major surfaces 276, 277. The body 271 can be regarded as having first and second circumferential portions thereof. In accordance with embodiments, the circumferentially arced outboard surface 273 can be longer than the circumferentially arc inboard surface 272, the radially oriented side surfaces 274, 275 extend between corresponding edges of the circumferentially arced inboard and outboard surfaces 272, 273 and the circumferentially arced inboard and outboard surfaces 272, 273 and the radially oriented side surfaces 274, 275 delimit respective areas of the forward and aft facing major surfaces 276, 277.

The first and second circumferential portions of the body 271 are arranged adjacent to one another and arranged together along the circumferential direction when the nozzle 270 is installed in the second front-face 233 of the diffuser baffle 230. The first circumferential portion of the body 271 includes a baffle 401 which is attached to the aft facing major surface 277. The baffle 401 has a baffle surface 402. The baffle surface 402 is angled relative to the aft facing major surface 277. The second circumferential portion of the body 271 can be formed to define an aperture 403. The aperture 403 extends through and is angled relative to the forward and aft facing major surfaces 276, 277 to define an angled flow path 410 upstream from the baffle 401. With the angled flow path 410 defined upstream from the baffle 401 by the aperture 403, the coolant supplied via the piping 290 flows through the angled flow path 410 and is directed circumferentially and tangentially toward the baffle surface 402 and then is deflected axially by the baffle surface 402. That is, the aperture 403 and the angled flow path 410 are angled such that the coolant is directed circumferentially at a relatively shallow angle toward the baffle 401 and the baffle surface 402 redirects the coolant in the axial direction and toward the impeller 210.

In accordance with embodiments and as shown in FIG. 4B, the forward and aft facing major surfaces 276, 277 can be planar or flat surfaces and can define respective planes P1, P2 thereof and the baffle surface 402 and the aperture 403 can each be angled relative to at least the plane P2 of the aft facing major surface 277. Further, the baffle surface 402 can form an acute angle BFA relative to at least the plane P2 of the aft facing major surface 277 and the aperture 403 can form an acute angle APA relative to at least the plane P2 of the aft facing major surface 277. The acute angle BFA and the acute angle APA can be different from one another.

Figure 5:
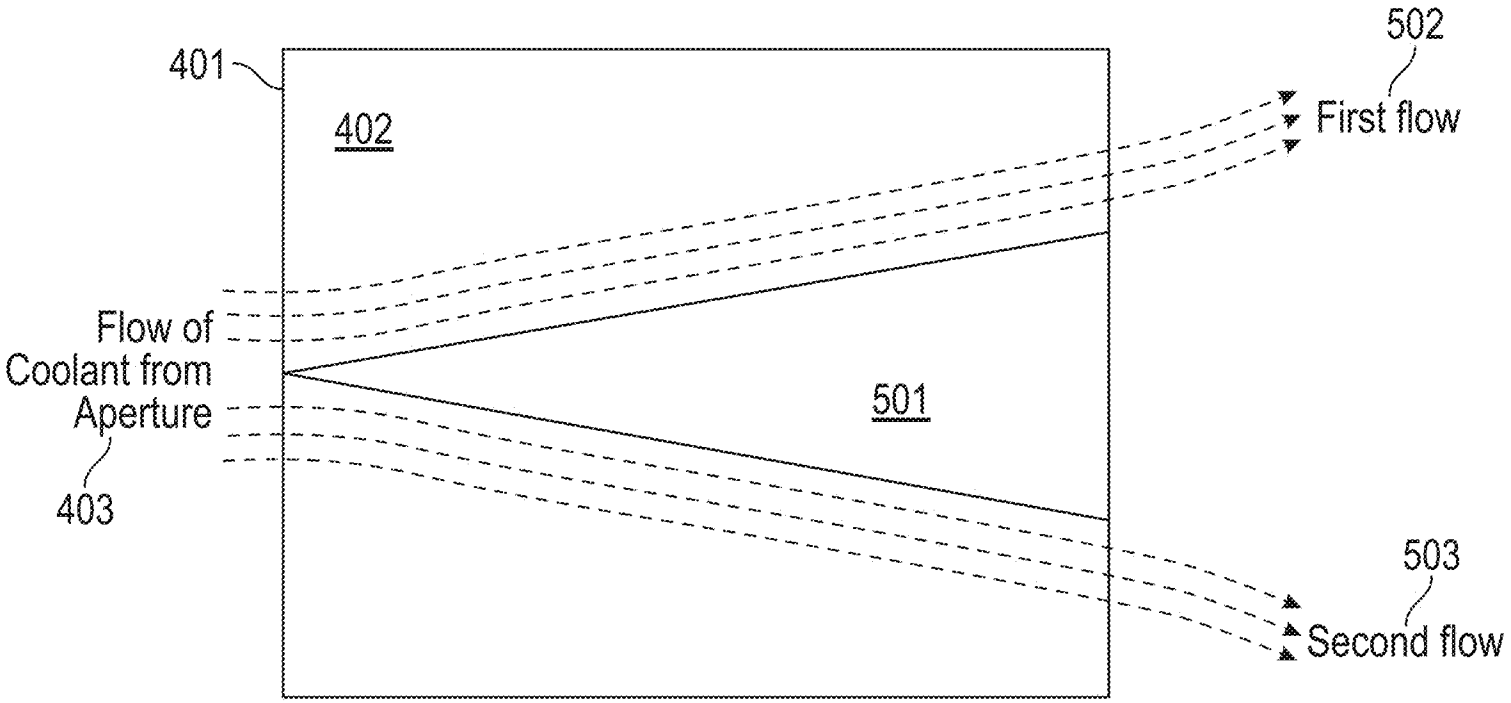
FIG. 5 is a plan view of a baffle of a nozzle with a bifurcating baffle in accordance with embodiments.

With continued reference to FIGS. 4A and 4B and with additional reference to FIG. 5, the baffle surface 402 can include a bifurcating baffle 501 to radially bifurcate a flow of the fluid into a first flow 502 and a second flow 503. In this way, a single set of a nozzle 270 and piping 290 can be used to direct coolant toward two separate locations on the impeller 210. The bifurcating baffle 501 can be one of more of relatively flat, curved, angled, tapered and/or airfoil-shaped.

Technical effects and benefits of the present disclosure are the provision of a system for cooling the back-face of an impeller using cooled bleed air that is tapped from a high-pressure location, such as compressed air that is bled from the highest stage of a compressor section (i.e., P3 air) and subsequently passed through a heat exchanger, directed to a nozzle and re-injected from the nozzle and tangentially toward the back-face of the impeller.

The corresponding structures, materials, acts and equivalents of all means or step plus function elements in the claims below are intended to include any structure, material, or act for performing the function in combination with other claimed elements as specifically claimed. The description of the present disclosure has been presented for purposes of illustration and description, but is not intended to be exhaustive or limited to the technical concepts in the form disclosed. Many modifications and variations will be apparent to those of ordinary skill in the art without departing from the scope and spirit of the disclosure. The embodiments were chosen and described in order to best explain the principles of the disclosure and the practical application and to enable others of ordinary skill in the art to understand the disclosure for various embodiments with various modifications as are suited to the particular use contemplated.

While the preferred embodiments to the disclosure have been described, it will be understood that those skilled in the art, both now and in the future, may make various improvements and enhancements which fall within the scope of the claims which follow. These claims should be construed to maintain the proper protection for the disclosure first described.

What is claimed is:

1. A nozzle of a diffuser baffle of a compressor section of a gas turbine engine of an aircraft, the nozzle comprising:

a body having circumferentially arced inboard and outboard surfaces, radially oriented side surfaces and forward and aft facing major surfaces, the body comprising a baffle attached to the aft facing major surface, the baffle having a baffle surface angled relative to the aft facing major surface, and the body defining an aperture, which extends through and which is angled relative to the forward and aft facing major surfaces, to define an angled flow path upstream from the baffle whereby fluid flowing through the angled flow path is directed tangentially toward and then deflected by the baffle surface.

2. The nozzle according to claim 1, wherein:

the circumferentially arced outboard surface is longer than the circumferentially arced inboard surface, the radially oriented side surfaces extend between corresponding edges of the circumferentially arced inboard and outboard surfaces, and the circumferentially arced inboard and outboard surfaces and the radially oriented side surfaces delimit the forward and aft facing major surfaces.

3. The nozzle according to claim 1, wherein:

the forward and aft facing major surfaces are planar surfaces and define respective planes thereof and the baffle surface and the aperture are each angled relative to at least the plane of the aft facing major surface, and the baffle surface forms an acute angle relative to at least the plane of the aft facing major surface and the aperture forms an acute angle relative to at least the plane of the aft facing major surface.

4. The nozzle according to claim 1, wherein the baffle surface comprises a bifurcating baffle to radially bifurcate a flow of the fluid into first and second flows.

5. A compressor section of a gas turbine engine of an aircraft, the compressor section comprising:

an impeller;

a diffuser baffle proximate to the impeller, whereby the impeller and the diffuser baffle define an intervening cavity therebetween;

a nozzle installed in the diffuser baffle and configured to direct a flow of coolant into the intervening cavity in a direction comprising circumferential and axial directional components; and piping extending through the diffuser baffle and terminating in the nozzle to deliver the flow of the coolant to the nozzle.

6. The compressor section according to claim 5, further comprising:

a compressor; and a heat exchanger, wherein the coolant comprises compressed air which is bled from the compressor and passed through the heat exchanger.

7. The compressor section according to claim 6, wherein the compressed air is sourced from the highest stage of the compressor.

8. The compressor section according to claim 6, wherein the piping extends from the heat exchanger and to and through the diffuser baffle.

9. The compressor section according to claim 5, wherein:

the nozzle comprises a body having circumferentially arced inboard and outboard surfaces, radially oriented side surfaces and forward and aft facing major surfaces, the body comprises a baffle attached to the aft facing major surface, the baffle having a baffle surface angled relative to the aft facing major surface, and the body defines an aperture, which extends through and which is angled relative to the forward and aft face major surfaces, to define an angled flow path upstream from the baffle whereby the coolant flows through the angled flow path and is directed circumferentially and tangentially toward the baffle surface and then is deflected axially by the baffle surface.

10. The compressor section according to claim 9, wherein:

the circumferentially arced outboard surface is longer than the circumferentially arced inboard surface, the radially oriented side surfaces extend between corresponding edges of the circumferentially arced inboard and outboard surfaces, and the circumferentially arced inboard and outboard surfaces and the radially oriented side surfaces delimit the forward and aft facing major surfaces.

11. The compressor section according to claim 9, wherein:

the forward and aft facing major surfaces are planar surfaces and define respective planes thereof and the baffle surface and the aperture are each angled relative to at least the plane of the aft facing major surface, and the baffle surface forms an acute angle relative to at least the plane of the aft facing major surface and the aperture forms an acute angle relative to at least the plane of the aft facing major surface.

12. The compressor section according to claim 9, wherein the baffle surface comprises a bifurcating baffle to radially bifurcate a flow of the fluid into first and second flows.

13. A compressor section of a gas turbine engine of an aircraft, the compressor section comprising:

an impeller comprising an impeller front-face along which high-temperature air flows and an impeller back-face opposite the impeller front-face;

a diffuser baffle proximate to the impeller, whereby the impeller back-face and the diffuser baffle define an intervening cavity therebetween;

a nozzle installed in the diffuser baffle and configured to direct a flow of coolant into the intervening cavity and tangentially toward the impeller back-face in a direction comprising circumferential and axial directional components; and piping extending through the diffuser baffle and terminating in the nozzle to deliver the flow of the coolant to the nozzle.

14. The compressor section according to claim 13, further comprising:

a compressor; and a heat exchanger, wherein the coolant comprises compressed air which is bled from the compressor and passed through the heat exchanger.

15. The compressor section according to claim 14, wherein the compressed air is sourced from the highest stage of the compressor.

16. The compressor section according to claim 14, wherein the piping comprises:

first piping extending from a highest stage of the compressor to the heat exchanger; and second piping extending from the heat exchanger to and through the diffuser baffle.

17. The compressor section according to claim 13, wherein:

the nozzle comprises a body having circumferentially arced inboard and outboard surfaces, radially oriented side surfaces and forward and aft facing major surfaces, the body comprises a baffle attached to the aft facing major surface, the baffle having a baffle surface angled relative to the aft facing major surface, and the body defines an aperture, which extends through and which is angled relative to the forward and aft face major surfaces, to define an angled flow path upstream from the baffle whereby the coolant flows through the angled flow path and is directed circumferentially and tangentially toward the baffle surface and then is deflected axially by the baffle surface.

18. The compressor section according to claim 17, wherein:

the circumferentially arced outboard surface is longer than the circumferentially arced inboard surface, the radially oriented side surfaces extend between corresponding edges of the circumferentially arced inboard and outboard surfaces, and the circumferentially arced inboard and outboard surfaces and the radially oriented side surfaces delimit the forward and aft facing major surfaces.

19. The compressor section according to claim 17, wherein:

the forward and aft facing major surfaces are planar surfaces and define respective planes thereof and the baffle surface and the aperture are each angled relative to at least the plane of the aft facing major surface, and the baffle surface forms an acute angle relative to at least the plane of the aft facing major surface and the aperture forms an acute angle relative to at least the plane of the aft facing major surface.

20. The compressor section according to claim 17, wherein the baffle surface comprises a bifurcating baffle to radially bifurcate a flow of the fluid into first and second flows.

* * * * *